United States Patent [19]

McLellan

[11] 4,100,462

[45] Jul. 11, 1978

[54] COMBINATION INCANDESCENT/FLUORESCENT LIGHTING SYSTEM

[76] Inventor: Norvel Jeff McLellan, 1002 N. Main, Pleasanton, Tex. 78064

[21] Appl. No.: 795,779

[22] Filed: May 11, 1977

[51] Int. Cl.[2] ..... H05B 35/00; H05B 41/18

[52] U.S. Cl. ..... 315/179; 315/362

[58] Field of Search ..... 315/179, 178, 180, DIG. 5, 315/362

[56] References Cited

U.S. PATENT DOCUMENTS

| | | | |
|---|---|---|---|
| 901,294 | 10/1908 | Hewitt | 315/179 X |
| 2,714,689 | 8/1955 | Waguet | 315/179 X |

*Primary Examiner*—Saxfield Chatmon, Jr.
*Assistant Examiner*—Charles F. Roberts
*Attorney, Agent, or Firm*—Gunn & Lee

[57] ABSTRACT

A combination incandescent/fluorescent lighting system is shown that gives an efficient, high quality light. An incandescent lamp in series with the fluorescent lamp is used as a ballast. An auxiliary starting circuit is used to create a high voltage for starting circuit flow through the fluorescent lamp. After current flow through the fluorescent lamp has started, the auxiliary circuit has essentially no effect on the remaining operation of the lighting system. A reversing switch for the fluorescent lamp is operable with an ON/OFF switch for reversing current flow through the fluorescent lamp each time the lighting system is cycled through ON/-OFF. This prevents the light inside of the fluorescent lamp from migrating to one end thereof. The circuit is designed for efficient operation from an auxiliary source of power, such as the wind or sun, either singularly or in combination with a standard AC power source.

12 Claims, 5 Drawing Figures

COMBINATION INCANDESCENT/FLUORESCENT LIGHTING SYSTEM

BACKGROUND OF THE INVENTION

The present invention relates to a combination incandescent fluorescent lighting system, and more particularly, to an efficient, high quality lighting system. The incandescent lamp provides ballast for the fluorescent lamp, and adds needed red output thereto. An anxiliary starting circuit is used to start circuit flow through the fluorescent lamp, and a reversing switch changes the direction of flow through the fluorescent lamp each time the fluorescent lamp is cycled through ON/OFF.

BRIEF DESCRIPTION OF THE PRIOR ART

Prior to the present invention, many different types of circuits have been designed for starting and using fluorescent lamps. However, because the resistance of a fluorescent lamp decreases as the current flow increases, some type of ballast is required to prevent excessive current flow through the fluorescent lamp. The ballast itself would consume power, sometimes even more than the fluorescent lamp, but would not provide any additional lighting. Also, the fluorescent lamp would not emit a sufficient amount of red light to keep from aggravating an individual's eyes. If the fluorescent lamp was operated off of an AC voltage, each time the voltage passed through zero, the fluorescent lamp would go OFF thereby causing a flickering effect of the fluorescent lamp. If the fluorescent lamp was operating off of a DC voltage, one end of the fluorescent lamp would soon polarize by the migration of light to one end, thereby decreasing its efficiency.

A typical circuit is shown in Gregory (U.S. Pat. No. 3,448,335) wherein a stepped-up transformer and a capacitor is used to start current flow through a fluorescent lamp. A similar type of discharge of a capacitor through a stepped-up transformer is also shown in Sturdevant (U.S. Pat. No. 3,536,955).

Also shown in the prior art are reversing switches that may be independently operated to reverse the direction of current flow through a fluorescent lamp upon polarization of the fluorescent tube. The polarization of a fluorescent tube involves the migration of the light inside of the tube to one end thereof. Such a reversing switch to prevent polarization is shown in Ott (U.S. Pat. No. 3,890,540). A much more complicated switching arrangement is shown in Tomsky (U.S. Pat. No. 3,858,087).

All of the prior art failed to show an efficient combination lighting system utilizing an incandescent lamp as ballast for a fluorescent lamp operated from an essentially DC power source, or a rectified and filtered AC source with a suitable automatic reversing switch to prevent polarization of the fluorescent lamp with an auxiliary circuit for starting current flow through the fluorescent lamp.

SUMMARY OF THE INVENTION

It is an object of the present invention to provide an efficient, high quality light utilizing a combination of incandescent/fluorescent lighting.

It is another object of the present invention to utilize incandescent lights as a ballast for a fluorescent light and to add additional red output to the fluorescent light.

It is yet another object of the present invention to provide an auxiliary starting circuit for the fluorescent lamp which improves the overall circuit efficiency.

Still another object of the present invention is to provide a combination incandescent/fluorescent lighting system that may be operated from a DC voltage. An automatic reversing switch reverses the current flow through the fluorescent lamp simultaneous with operation of the ON/OFF switch.

Still a further object of the present invention is to provide an efficient, high quality lighting system that may be operated from a source of power, such as the sun or wind, and also from a standard AC power system in common use.

Once conduction of the system has begun, current flows through a series connection of an ON/OFF switch, a reversing switch, incandescent lamp, fluorescent lamp, and a diode. An auxiliary circuit is connected in parallel with the diode for beginning conduction through the fluorescent lamp (commonly called "striking" or "firing") of the fluorescent lamp. The auxiliary circuit may include a group of capacitors connected in parallel to charge while the ON/OFF switch is OFF, and discharged in series through the fluorescent lamp upon turning the ON/OFF switch ON. Another configuration permits the charging of a capacitor while the ON/OFF switch is OFF, and thereafter discharging the capacitor through a stepped-up transformer upon turning the ON/OFF switch ON to cause the initial current flow through the fluorescent lamp.

Still another alternative for the auxiliary circuit is to control the firing point of a silicon control rectifier which in turn controls a stepped-up transformer for the initial current flow through the fluorescent lamp. The firing of the silicon control rectifier may be accurately set by a neon arc lamp. Likewise, the auxiliary firing circuit may be operated from a rectified AC voltage having capacitors forming a voltage multiplier for discharge through the fluorescent lamp upon closing the ON/OFF switch.

DESCRIPTION OF THE PREFERRED EMBODIMENT

Figure 1:
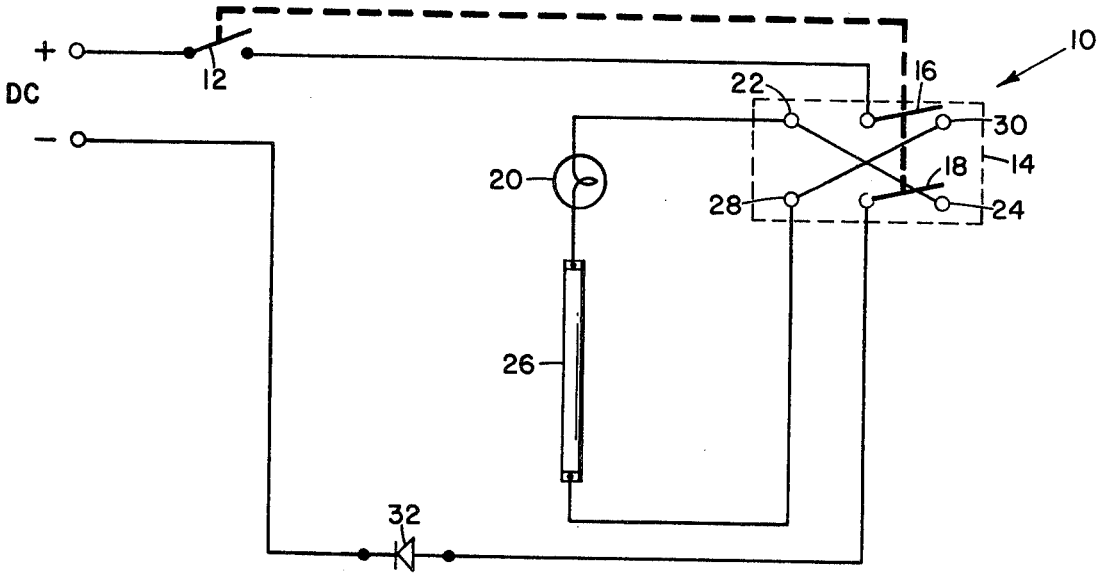
FIG. 1 is an equivalent circuit diagram of the combination incandescent/fluorescent lighting system showing the elements that conduct during normal operation.

Referring to FIG. 1 of the drawings, there is shown an equivalent schematic diagram of all elements of the basic circuit that conduct during normal operation of the incandescent/fluorescent lighting system as will be described more fully hereinbelow.

DC voltage is fed into the basic circuit represented generally by reference numeral 10. An ON/OFF switch 12 connects the DC voltage to a reversing switch 14 having wiper arms 16 and 18. Incandescent lamp 20 is connected in series with opposing contacts 22 and 24 of reversing switch 14. Fluorescent lamp 26, which is also in series connection with incandescent lamp 20, is connected in series with opposing contacts 28 and 30 of reversing switch 14. While ON/OFF switch 12 is connected in series with wiper arm 16 of reversing switch 14, diode 32 is connected in series with wiper arm 18 to the opposite side of the input DC voltage. By a gang connection of the ON/OFF switch 12 to the reversing switch 14, each time the ON/OFF switch 12 is depressed to close the basic circuit 10, the reversing switch 14 is changed to reverse the polarity on incandescent lamp 20 and fluorescent lamp 26. However, when the ON/OFF switch 12 is released, the reversing switch 14 remains the same.

The reversing switch 14 is necessary for DC operation of a fluorescent light because one end of the fluorescent light tends to get dark after a period of operation thereby causing a loss in efficiency due to increased voltage requirements for the fluorescent lamp. The loss of efficiency and the darkness of one end of the fluorescent lamp is caused by migration of the phosphor inside of the fluorescent lamp. By periodically reversing the current flow through the fluorescent lamp, migration of the phosphor coating on the inside of the fluorescent lamp tube can be equalized.

The diode 32 is a bypass for firing the basic circuit 10 to start current conduction through the incandescent lamp 20 and fluorescent lamp 26. The auxiliary circuits for firing the fluorescent lamp 26 will be described hereinafter in conjunction with the remaining figures. After conduction through the incandescent lamp 20 and fluorescent lamp 26 has begun, conduction will continue through the diode 32.

Figure 2:
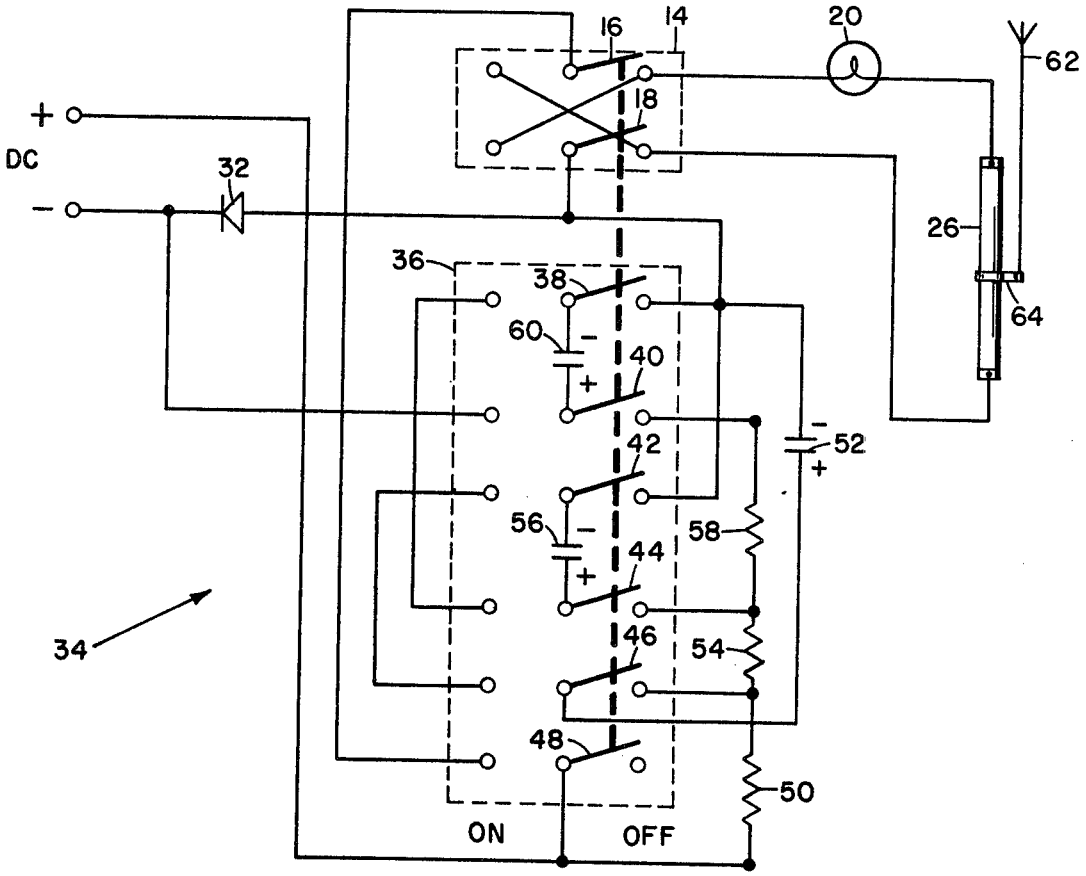
FIG. 2 is a schematic diagram of a first embodiment of the present invention.

Referring to FIG. 2 of the drawings, there is shown a capacitive firing circuit represented generally by reference numeral 34. Like numerals that were used to describe like components in FIG. 1 will also be used in conjunction with the description of FIG. 2. The ON/-OFF switch 12, as previously described in conjunction with FIG. 1, has been replaced with a multiple pole, double-throw switch 36. While the number of poles of the multiple pole, double-throw switch 36 may vary, the present invention is illustrated with six poles each having its own wiper arm 38, 40, 42, 44, 46 and 48, respectively.

When the switch 36 is in the position as shown in FIG. 2 (the OFF position), current will flow through resistor 50 and wiper arm 46 to charge capacitor 52 through diode 32. In parallel with capacitor 52 is resistor 54 which allows current flow through wiper arm 44 to charge capacitor 56 via current flow through wiper arm 42 and diode 32. Likewise, in parallel with capacitor 56 is a resistor 58 and wiper 40 for charging capacitor 60 via wiper arm 38 and diode 32. When the switch 36 is in the position as shown in FIG. 2, all of the capacitors 52, 56 and 60 are connected in parallel. Upon charging of the capacitors 52, 56 and 60, the capacitive firing circuit 34 is essentially an open circuit. Upon turning the switch 36 ON, which simultaneously operates the reversing switch 14, each of the capacitors 52,-56 and 60 is then connected in series with the incandescent lamp 20 and fluorescent lamp 26 via wiper arm 18 which connects in consecutive order with capacitor 52, wiper arm 46, wiper arm 42, capacitor 56, wiper arm 44, wiper arm 38, capacitor 60 and wiper arm 40 to the negative side of the input DC voltage. Assume for example that the DC input voltage is approximately 200 volts. Since each of the capacitors 52, 56 and 60 were charged to approximately 200 volts when switch 36 was in the OFF position, upon series connection, the capacitors 52, 56 and 60 have an equivalent voltage of approximately 600 volts for firing a fluorescent lamp 26. Once conduction has begun through the fluorescent lamp 26, it will be maintained through diode 32 and wiper arm 48 of switch 36.

Resistors 50, 54 and 58 are necessary for protection of the contacts of switch 36.

An antenna 62 is provided with a strap 64 around fluorescent lamp 26. The antenna 62 will aid in the firing of fluorescent lamp 26 because of the radiation picked up from the atmosphere by the antenna 62. The antenna 62 may extend in any convenient direction. Applicant has found that extension of the antenna 62 by approximately 6 feet through the ceiling of a building behind the location of incandescent lamp 26 to be very convenient for radiation effects thereby aiding the firing of the fluorescent lamp 26.

Again, the switch 36, the same as ON/OFF switch 12 in FIG. 1, is gang connected to reversing switch 14 to reverse the position of wiper arms 16 and 18 upon turning switch 36 ON, but no change upon turning switch 36 OFF.

Figure 3:
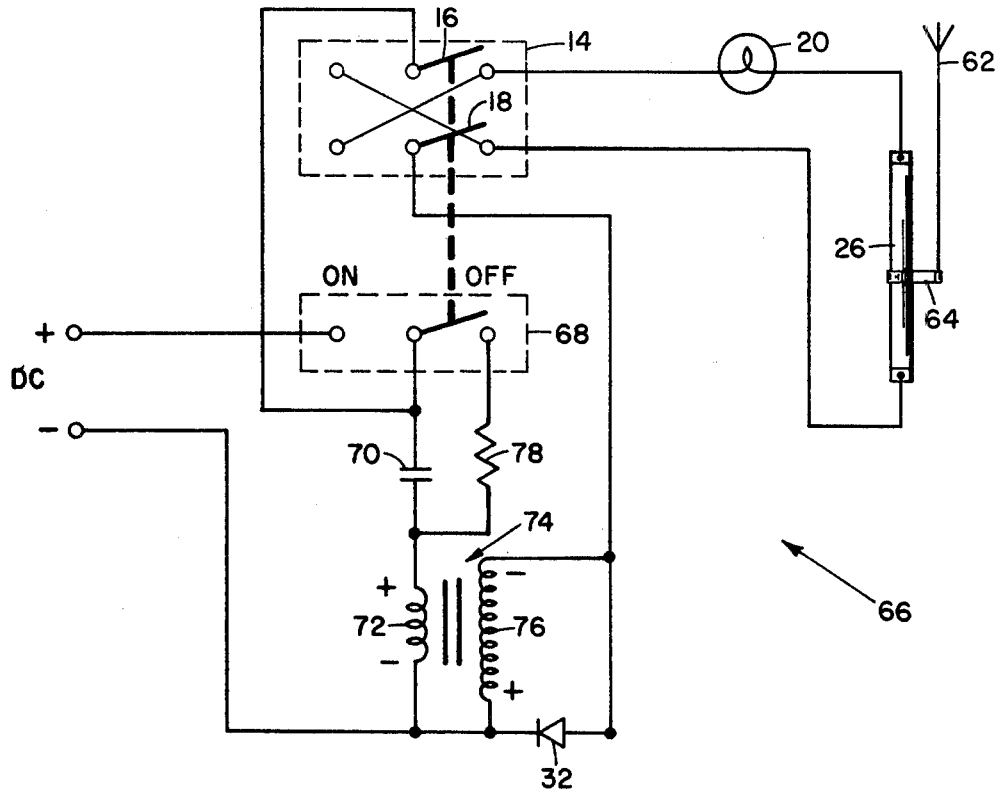
FIG. 3 is a schematic diagram of a second embodiment of the present invention.

Referring now to FIG. 3, there is shown an inductive firing circuit represented generally by reference numeral 66. Again, like numerals used to describe like components previously described in FIGS. 1 and 2 will be utilized. The positive side of the input of the DC voltage is connected through ON/OFF switch 68 which is gang connected with reversing switch 14 as previously described. When the ON/OFF switch 68 is moved to the ON position, capacitor 70 allows initial current flow therethrough to the primary winding 72 of stepped-up transformer 74. Current flow through the primary winding 72 will give a high voltage output from the secondary winding 76 which is connected in series with the incandescent lamp 20 and fluorescent lamp 26 through the reversing switch 14. This initial high voltage output will start the conduction of fluorescent lamp 26 which will be maintained through diode 32. As the current charges capacitor 70, transformer 74 will be eliminated from the circuit. When the ON/OFF switch 68 is turned to the OFF position, resistor 78 discharges capacitor 70. Discharged capacitor 70 is now ready to pass current upon turning the ON/OFF switch 68 back to the ON position.

Figure 4:
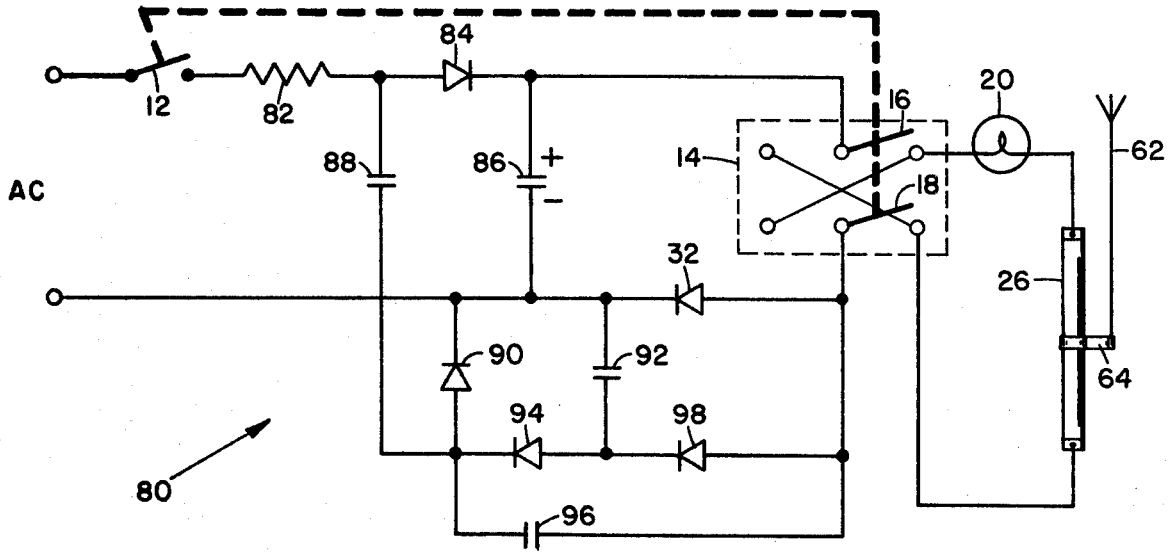
FIG. 4 is a schematic diagram of a third embodiment of the present invention.

Referring to FIG. 4 of the drawings, there is shown a firing circuit for AC voltage represented generally by reference numeral 80. Like numerals as previously used will be used in conjunction with the description of FIG. 4 when appropriate to represent like components. An input AC voltage is connected through ON/OFF switch 12 which is again gang connected with reversing switch 14 as previously described. Upon closing ON/-OFF switch 12, current will flow through surge limiting resistor 82 and diode 84 during one-half of the cycle to charge capacitor 86 as shown. The charge in capacitor 86 gives essentially a DC voltage connected across the wiper arms 16 and 18 of reversing switch 14. Therefore, essentially a DC voltage will be connected across incandescent lamp 20 and fluorescent lamp 26.

Capacitor 88 is connected in series with diode 90 across the input AC voltage. Capacitor 92 and diode 94 are connected in parallel with diode 90. Likewise, capacitor 96 and diode 98 are connected in parallel with diode 94. The connection of capacitors 88, 92 and 96 in combination with diodes 90, 94 and 98 make up a multiplier circuit that applies a reverse voltage across diode 32 approximately three times the peak input AC voltage with a ripple component of approximately peak-to-peak input AC voltage. This reverse voltage across diode 32, plus the voltage of capacitor 86, fires fluorescent lamp 26 to begin conduction. Current through the firing circuit 80 shorts diode 32, but because capacitor 88 is an AC capacitor, it will consume very little power.

Figure 5:
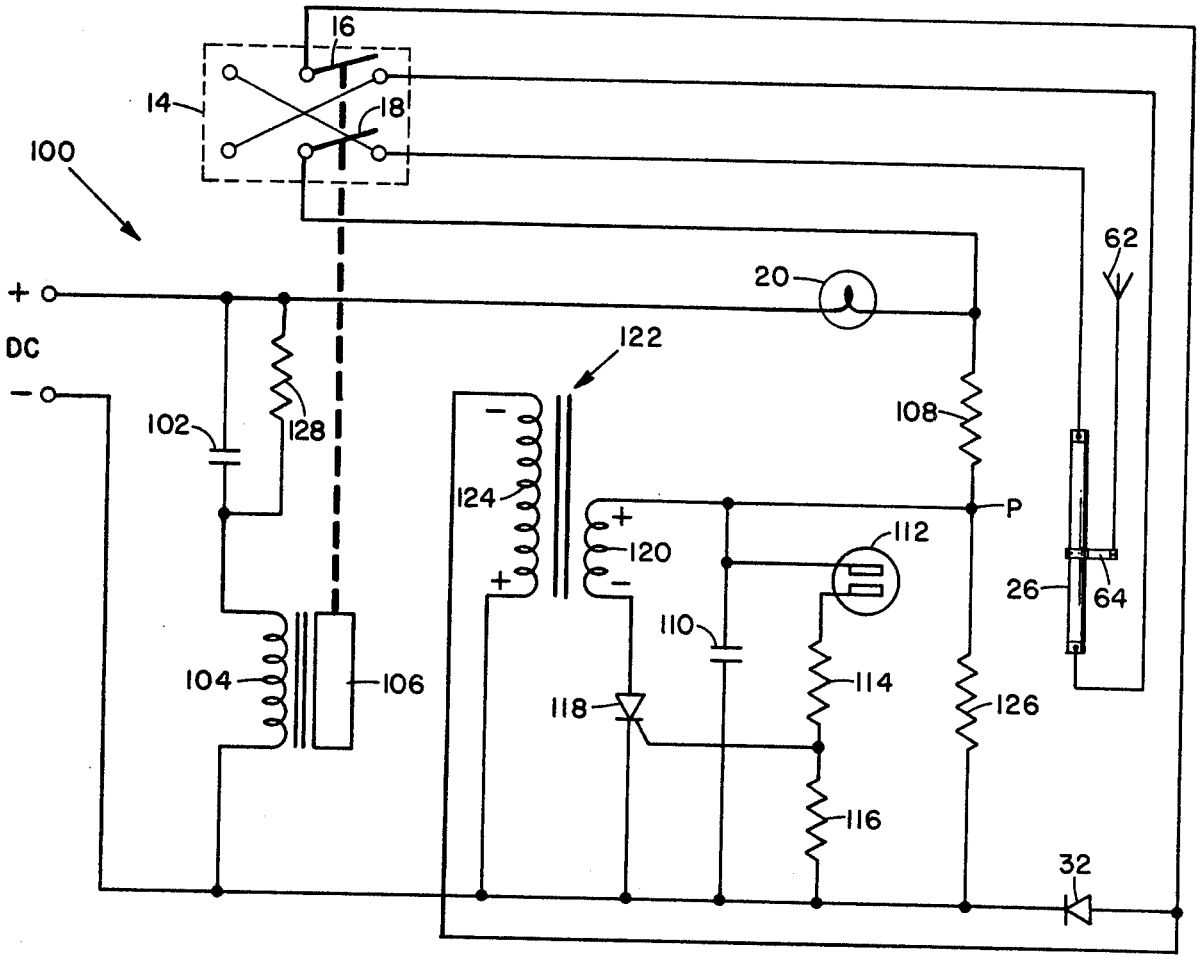
FIG. 5 is a schematic diagram of a fourth embodiment of the present invention.

Referring to FIG. 5 of the drawings, there is shown a schematic diagram represented generally by reference numeral 100 for turning ON more than one fluorescent lamp from one switch. By applying the input DC voltage from some remote location, current will flow through capacitor 102 and solenoid 104 thereby causing movement of the iron core 106 of the solenoid 104. Movement of the iron core 106 will operate reversing switch 14 in the manner previously described to change the position of wiper arms 16 and 18 only upon initial movement of iron core 106. Current will begin flowing through incandescent lamp 20 and resistor 108 to charge capacitor 110. Connected in parallel with capacitor 110 is neon arc lamp 112 and resistor 114 and 116. When the voltage on capacitor 110 reaches the firing voltage of the neon arc lamp 112, the neon arc lamp 112 will fire causing current flow through resistor 114 and the gate of silicon control rectifier 118. Silicon control rectifier 118 discharges capacitor 110 through the primary winding 120 of stepped-up transformer 122. The discharge of capacitor 110 through the primary winding 120 causes the secondary winding 124 to give an increased voltage output through reversing switch 14 across fluorescent lamp 26. The increased voltage output will cause fluorescent lamp 26 to begin conduction which is maintained through diode 32. Resistor 114 is a current limiter for the gate of silicon control rectifier 118. Resistor 116 provides a leakage path for the gate of silicon control rectifier 118. Parallel resistor 126 is included in case operating voltage of the fluorescent lamp 26 is higher than the firing voltage of neon arc lamp 112.

When the fluorescent lamp 26 is conducting, voltage at point P is lower than firing voltage of neon lamp 112. Resistor 108 reduces the current flow therethrough to below the holding current for silicon control rectifier 118. Therefore, after firing of the silicon control rectifier 118, which causes current flow through fluorescent lamp 26, conduction through silicon control rectifier 118 will cease. Upon removing the input DC voltage, charge on capacitor 102 is quickly discharged through resistor 128. Upon reapplying the input DC voltage, current flow through capacitor 102 and solenoid 104 will again move the iron core 106 (plunger) of the solenoid thereby actuating reversing switch 14. The reversing switch 14 does not change positions upon removal of the input DC voltage.

By use of one of the embodiments as described hereinabove, an efficient, high quality lighting system can be provided utilizing both incandescent and fluorescent lamps. The incandescent lamp 20 acts as a ballast for the fluorescent lamp 26. A ballast is necessary for a fluorescent lamp because as current flow through a fluorescent lamp increases, the resistance decreases. The reverse is true for the incandescent lamp 20. Most ballasts used in conjunction with fluorescent lamps require more power than the fluorescent lamp itself. By use of an incandescent lamp 20 in conjunction with the fluorescent lamp 26, the power consumed in the ballast can be used to generate light. Also, the fluorescent lamp 26, as is the case with all fluorescent lamps, has very little infrared light. The incandescent lamp 20 provides the amount of infrared light necessary for a pleasing effect to the eye.

After approximately 60 hours of operation of a fluorescent lamp on a DC voltage, one end of the lamp will get dark indicating migration of the phosphor coating to one end of the tube. By reversing the current flow through the incandescent lamp, migration of the phosphor coating in both directions can be approximately equated. The migration of the fluorescent coating increases the resistance of the fluorescent lamp thereby requiring increased voltage for firing of the fluorescent lamp.

By use of a lighting system as previously described herein, it becomes very feasible to use auxiliary or independent power sources utilizing natural energy, such as the sun and wind. This type of power source may be operated independently or in conjunction with standard power systems. If approximately 150 volts DC was the standard design parameter of the circuits described hereinabove, the change from standard AC voltage to the present system would be very economical, plus having an additional feature of operation on standard alternating voltage in case of lack of sun or wind power.

I claim:

1. A combination incandescent/fluorescent lighting system for providing an efficient, high quality light, said lighting system comprising:

a source of direct current;

incandescent lamp means connected to said source of direct current;

fluorescent lamp means connected in series with said incandescent lamp means and said source of direct current, said incandescent lamp means being a ballast for said fluorescent lamp means;

bypass means in series with said fluorescent lamp means;

auxiliary circuit means in parallel with said bypass means to start current flow through said fluorescent lamp means, said bypass means thereafter maintaining current flow through said incandescent lamp means and fluorescent lamp means;

reversing means for changing the direction of current flow through said fluorescent lamp means during periods when no current is flowing therethrough.

2. The combination incandescent/fluorescent lighting system as given in claim 1 includes an ON/OFF switch means for applying power to said incandescent lamp means and said fluorescent lamp means, said reversing means being operable by said ON/OFF switch means.

3. The combination incandescent/fluorescent lighting system as given in claim 2 wherein said auxiliary circuit means includes a multiple pole, double-throw switch means forming said ON/OFF switch means, a plurality of capacitors being connected in parallel across said source of direct current via said multiple pole, double-throw switch means when no current is flowing through said incandescent lamp means and fluorescent lamp means, upon switching said multiple pole, double-throw switch means said plurality of capacitors being connected in series across said bypass means to start current flow through said fluorescent lamp means.

4. The combination incandescent/fluorescent lighting system as given in claim 3 including antenna means contiguous with said fluorescent lamp means and extending into atmosphere for radiation pickup to aid current flow through said fluorescent lamp means.

5. The combination incandescent/fluorescent lighting system as given in claim 2 wherein said auxiliary circuit includes stepped-up transformer means in parallel with said bypass means for increasing initial voltage to said fluorescent lamp means, first capacitor means in series with said stepped-up transformer means eliminating said stepped-up transformer means from parallel connection across said bypass means after initial current flow through said fluorescent lamp means.

6. The combination incandescent/fluorescent lighting system as given in claim 5 wherein said first capacitor means is in series with a primary winding of said stepped-up transformer, a secondary winding of said stepped-up transformer being in parallel with said bypass means.

7. The combination incandescent/fluorescent lighting system as given in claim 2 wherein said source of direct current is obtained from a rectified, filtered alternating current.

8. The combination incandescent/fluorescent lighting system as given in claim 7 wherein said auxiliary circuit means includes a voltage multiplier circuit operable from a half waveform of said alternating current, said multiplier circuit applying a multiplied reverse voltage across said bypass means upon initial current flow.

9. The combination incandescent/fluorescent lighting system as given in claim 8 wherein said multiplier circuit is a plurality of second capacitor means and diode means connected to said alternating current.

10. The combination incandescent/fluorescent lighting system as given in claim 1 includes a solenoid means operable by initial current flow from said source of direct current to operate said reversing means.

11. The combination incandescent/fluorescent lighting system as given in claim 10 includes stepped-up transformer means connected in parallel with said bypass means, a primary winding of said stepped-up transformer means being operable by a gate means upon a predetermined charge of third capacitor means located across said primary winding being exceeded.

12. The combination incandescent/fluorescent lighting system as given in claim 11 including neon arc lamp means connected across said third capacitor means to said gate means, upon firing of said neon arc lamp means at said predetermined charge of said third capacitor means, said gate means conducting thereby causing current flow through said primary winding, current flow through said primary winding causing current flow through said secondary winding and said fluorescent lamp means.

* * * * *